US007912587B2

(12) United States Patent
Walters et al.

(10) Patent No.: US 7,912,587 B2
(45) Date of Patent: Mar. 22, 2011

(54) METHOD OF BALANCING A GAS TURBINE ENGINE ROTOR

(75) Inventors: Cameron Todd Walters, Newmarket (CA); Richard Benoit, Beloeil (CA); Alphonse Bellemare, Boucherville (CA); Ronald Leslie Robinson, Brampton (CA); Jiemin Wang, Mississauga (CA); Harry Harris, Georgetown (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 580 days.

(21) Appl. No.: 11/782,966

(22) Filed: Jul. 25, 2007

(65) Prior Publication Data

US 2009/0025461 A1 Jan. 29, 2009

(51) Int. Cl.
*G05B 19/00* (2006.01)
*G01D 1/00* (2006.01)

(52) U.S. Cl. ..... 700/279; 700/287; 324/154 R; 73/66; 415/99; 415/119; 416/144; 702/127

(58) Field of Classification Search ..... 700/279, 700/287; 324/154 R; 310/261.1; 73/66; 415/119, 99; 416/144; 702/127; 29/23.51
See application file for complete search history.

(56) References Cited

U.S. PATENT DOCUMENTS

| | | | | |
|---|---|---|---|---|
| 3,952,602 | A | 4/1976 | Lyman et al. | |
| 5,214,585 | A | 5/1993 | Ehrich | |
| 5,408,875 | A | 4/1995 | Matsushita et al. | |
| 5,502,650 | A | 3/1996 | Naruse et al. | |
| 5,537,861 | A | 7/1996 | Seitelman et al. | |
| 5,627,761 | A * | 5/1997 | Pollard | 700/279 |
| 5,627,762 | A | 5/1997 | Cameron et al. | |
| 6,341,419 | B1 * | 1/2002 | Forrester et al. | 29/889.2 |
| 6,893,222 | B2 * | 5/2005 | Allam | 416/144 |
| 6,898,547 | B1 | 5/2005 | DeBlois et al. | |
| 7,085,665 | B2 | 8/2006 | Park | |
| 7,186,079 | B2 | 3/2007 | Suciu et al. | |
| 7,243,023 | B2 * | 7/2007 | Skilton | 701/124 |
| 7,377,749 | B2 * | 5/2008 | Charrier et al. | 416/119 |
| 2005/0234576 | A1 | 10/2005 | Lee | |
| 2006/0130488 | A1 | 6/2006 | Suciu et al. | |
| 2007/0014660 | A1 | 1/2007 | Lee | |
| 2009/0165273 | A1 * | 7/2009 | Calvert et al. | 29/281.5 |
| 2009/0234481 | A1 * | 9/2009 | Lee et al. | 700/98 |

FOREIGN PATENT DOCUMENTS

| | | | |
|---|---|---|---|
| EP | 0 962 660 | | 12/1999 |
| JP | 2001200705 | * | 1/2000 |
| WO | WO 95/34871 | | 12/1995 |
| WO | WO 03/060453 | | 7/2003 |

OTHER PUBLICATIONS

Axiam Incorporated Product Brochure of GMX 4000 Smart Stack TM Systems, "For Assembly of Aircraft Jet Engines and Industrial Gas Turbines" (1991).*

(Continued)

*Primary Examiner* — Albert Decady
*Assistant Examiner* — Olvin Lopez
(74) *Attorney, Agent, or Firm* — Ogilvy Renault

(57) ABSTRACT

A method of balancing an assembly of rotary parts of a gas turbine engine comprising measuring at least one of the concentricity and parallelism of each component and considering globally all possible component stacking positions to generate an optimized stacking position for each component of the assembly to minimize assembly unbalance.

22 Claims, 12 Drawing Sheets

OTHER PUBLICATIONS

Axiam Incorporated Product Brochure of Axiam's Rotor Assembly Process, Tools & Training, "Build Engine Rotors Within Compliance Reduce Turn Time, Decrease Vibration and Cut Costs" (1991).*

"A New Practical Modal Method for Rotor Balancing", Bingang Xu and Liangsheng Qu, Research Institute of Diagnostics and Cybernetics, School of Mechanical Engineering, Xi'an Jiaotong University, People's Republic of China.

Axiam Incorporated, Engine Vibration Management & Performance Solutions.

"Balance This" Case Histories from Difficult Balance Jobs, Troy D. Feese, P.E. and Philip E. Grazier, Engineering Dynamics Incorporated, San Antonio, Texas.

"Complex Modal Balancing of Flexible Rotors Including Residual Bow", Paper 87-1840, Joint Propulsion Conference, vol. 4, No. 3, May-Jun. 1988.

"Compressors: Selection and Sizing" Royce N. Brown.

"Machinery Vibration: Balancing", Victor Wowk, McGraw-Hill, Inc.

"A Modified Balancing Method for Flexible Rotors Based on Multi-Sensor Fusion", Liu Shi, Journal of Applied Sciences 5 (3): 465-469, 2005.

Precitech: FMS Form Measurement Systems: Defining Measurement in Ultra Precision.

"Review: Rotor Balancing" W.C. Folies, P.E. Allaire and E.J. Gunter, Schock and Vibration 5 (1998) 325-336.

"Rotor Balancing Without Trial Weights" A. El-Shafei, A.S. El-Kabbany, A.A. Younan, Transactions of the ASME, vol. 126, Jul. 2004.

"Steady Synchronous Response and Balancing of Rotor Systems with Residual Shaft Bow", Harold D. Nelson, International Journal of Rotating Machinery, 8(6): 431-438, 2002.

"Using Manufacturing Tolerances and Practices to Minimize Unbalance", David Bayley, Schenck Trebel.

* cited by examiner

METHOD OF BALANCING A GAS TURBINE ENGINE ROTOR

TECHNICAL FIELD

The invention relates generally to a method of balancing an assembly of rotary components of a gas turbine engine.

BACKGROUND OF THE ART

It is routine for gas turbine engines to have to pass stringent vibration acceptance tests following production. If an engine does not pass the vibration acceptance limit, it typically must be disassembled, re-balanced, and reassembled, which wastes time and resources.

Accordingly, there is a need to provide improved methods of balancing an assembly of rotary components.

SUMMARY

In one aspect, there is provided a method of balancing a rotor assembly comprising first and second rotors adapted to be coupled together, and a stack of intermediate components clamped between the first and second rotors, the method comprising: determining a relative angular position of the first and second rotors, the so angularly positioned first and second rotors respectively providing first and second reference faces defining a space therebetween for receiving the stack of intermediate components, and determining a stacking angular position of each of said intermediate components using geometrical data on said intermediate components and said first and second reference faces.

In a second aspect, there is provided a method of balancing a first rotor pack comprising a plurality of assembled rotor components and a coupling interface for connection to a second rotor pack, the method comprising: measuring said coupling interface to establish a reference axis line, and referencing said rotor components back to said reference axis line in order to establish individual angular stacking positions of said rotor components.

In a third aspect, there is provided a method of balancing a rotor assembly comprising first and second rotor packs, the first and second rotor packs being coupled to each other at a coupling interface, the method comprising separately balancing the first and second rotor packs, and determining the relative angular positioning of the first and second packs considering a measured geometry of the coupling interface.

In a fourth aspect, there is provided a method of balancing an assembly of rotary components including first and second main components and intermediate components adapted to be positioned in-between, each rotary component having at least one mating face, a respective reference and a plurality of stacking positions, the method comprising the steps of:

measuring the concentricity of the first and second main components;

measuring the parallelism of the mating faces of the first and second main components relative to the respective references;

generating an assembly unbalance for each combination of first and second main component stacking positions, determining the lowest assembly unbalance and defining the first and second main component stacking positions of the lowest assembly unbalance as optimal first and second main component stacking positions;

measuring the parallelism of the mating faces of each intermediate component relative to the respective references;

generating an assembly unbalance for each combination of intermediate component stacking positions relative to the optimal first and second main component stacking positions, determining the lowest assembly unbalance and defining the intermediate component stacking positions of the lowest assembly imbalance as optimal intermediate component stacking positions.

Further details of these and other aspects will be apparent from the detailed description and figures included below.

DESCRIPTION OF THE DRAWINGS

Reference is now made to the accompanying figures in which:

FIG. 6 is a schematic view of a series of points representing two different faces on the HPC impeller recorded in a 3-dimensional XYZ plane by the measuring system of FIG. 4;

DETAILED DESCRIPTION OF THE PREFERRED EMBODIMENTS

Figure 1:
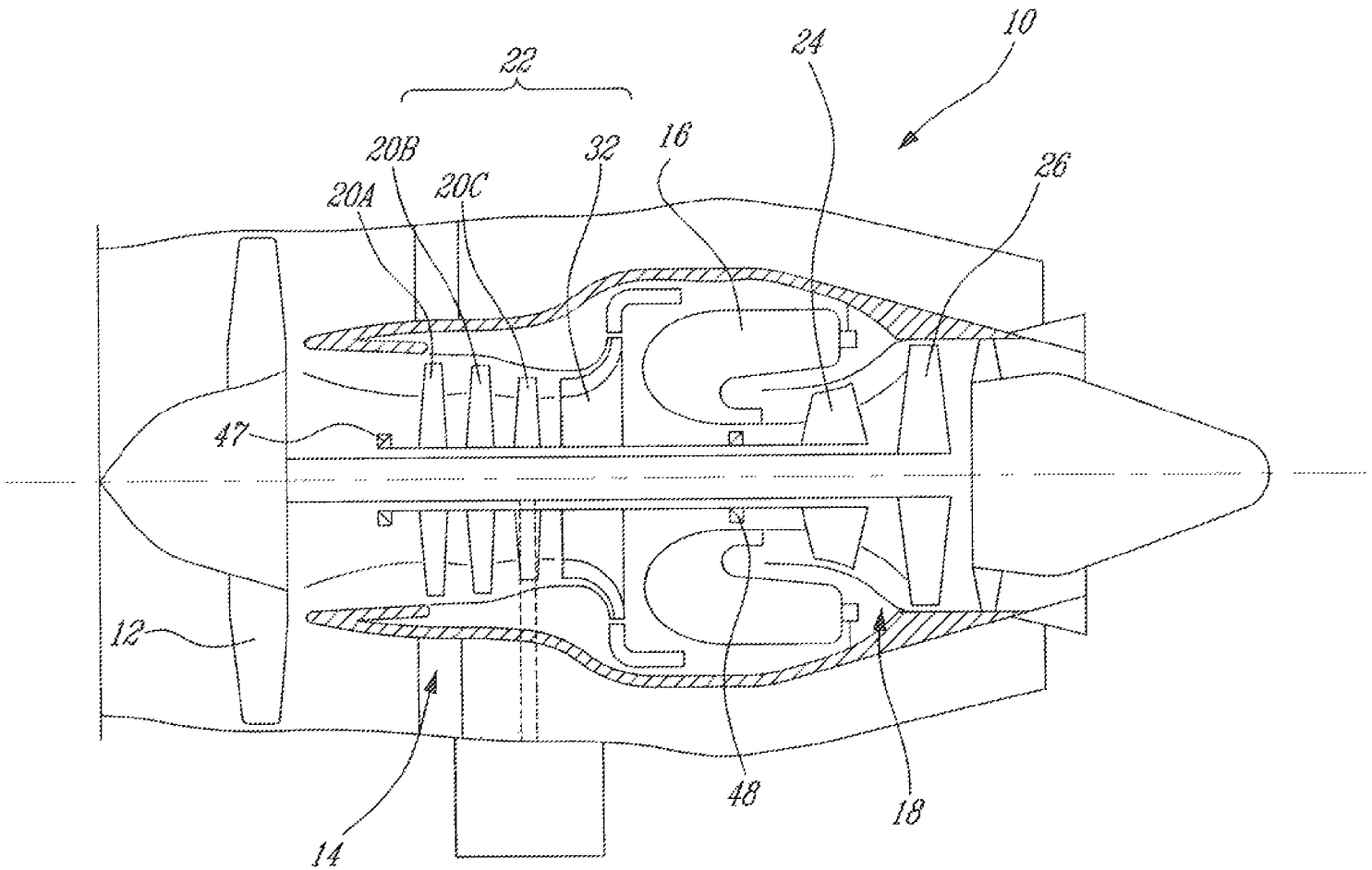
FIG. 1 is a schematic view of a gas turbine engine including an exemplary rotor assembly including a high pressure compressor (HPC) impeller and a high pressure turbine (HPT) first disk.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel, and ignited for generating an annular stream of hot combustion gases, and a turbine section 18 for extracting energy from the combustion gases.

Generally, the gas turbine engine 10 comprises a plurality of assemblies having rotary components mounted for rotation about a centerline axis 11 of the engine 10. For instance, the compressor 14 section may include a high pressure compressor (HPC) pack 22 having multiple stages. The turbine section 18 downstream of the combustor 16 includes a high pressure turbine (HPT) pack 24 that drives the HPC 22 and a low pressure turbine (LPT) 26 that drives the fan 12.

Figure 2:
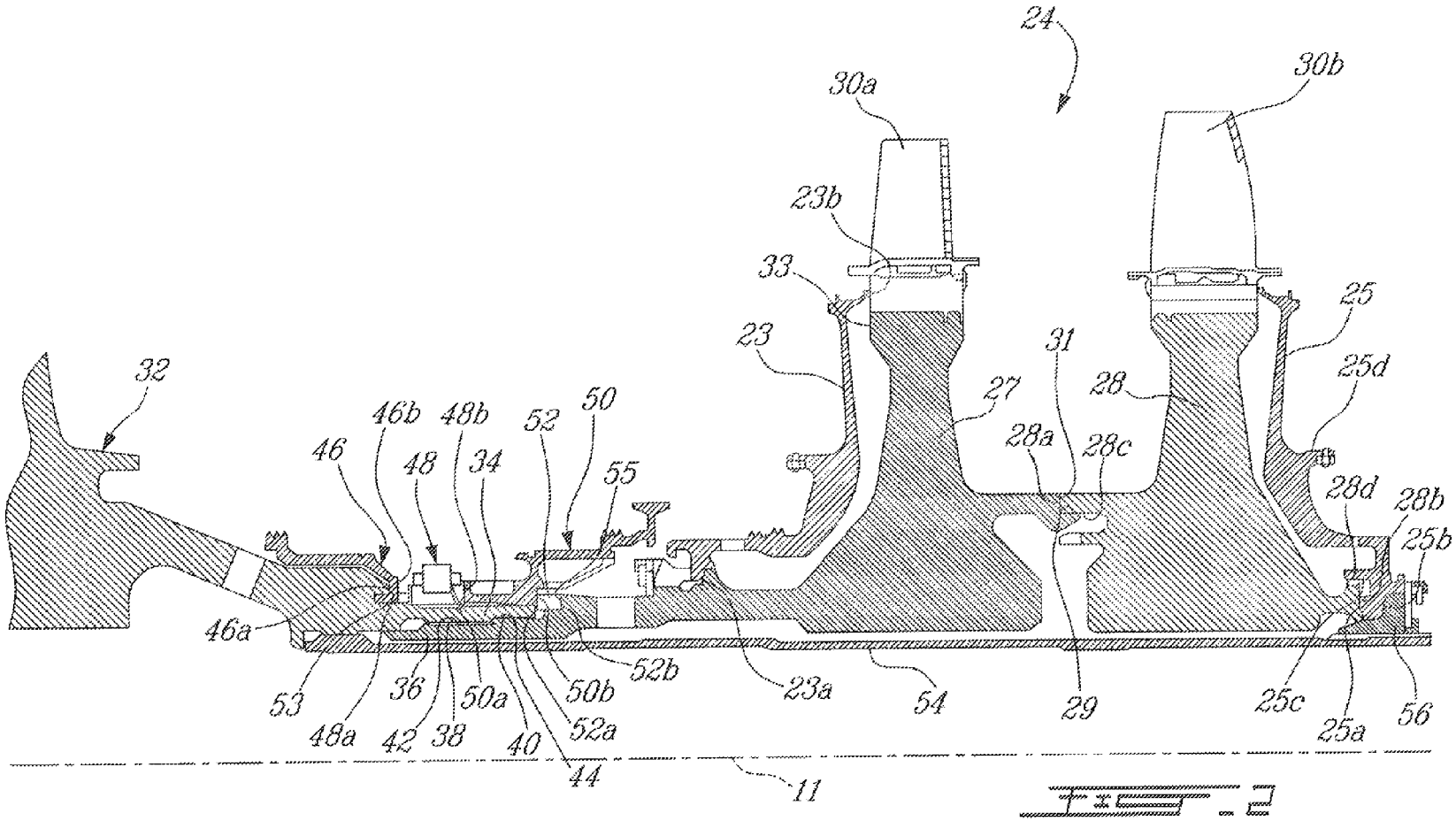
FIG. 2 is a sectional view of the rotor assembly of the gas turbine engine of FIG. 1, shown in cross-section along an axial centerline of the gas turbine engine.
Figure 3:
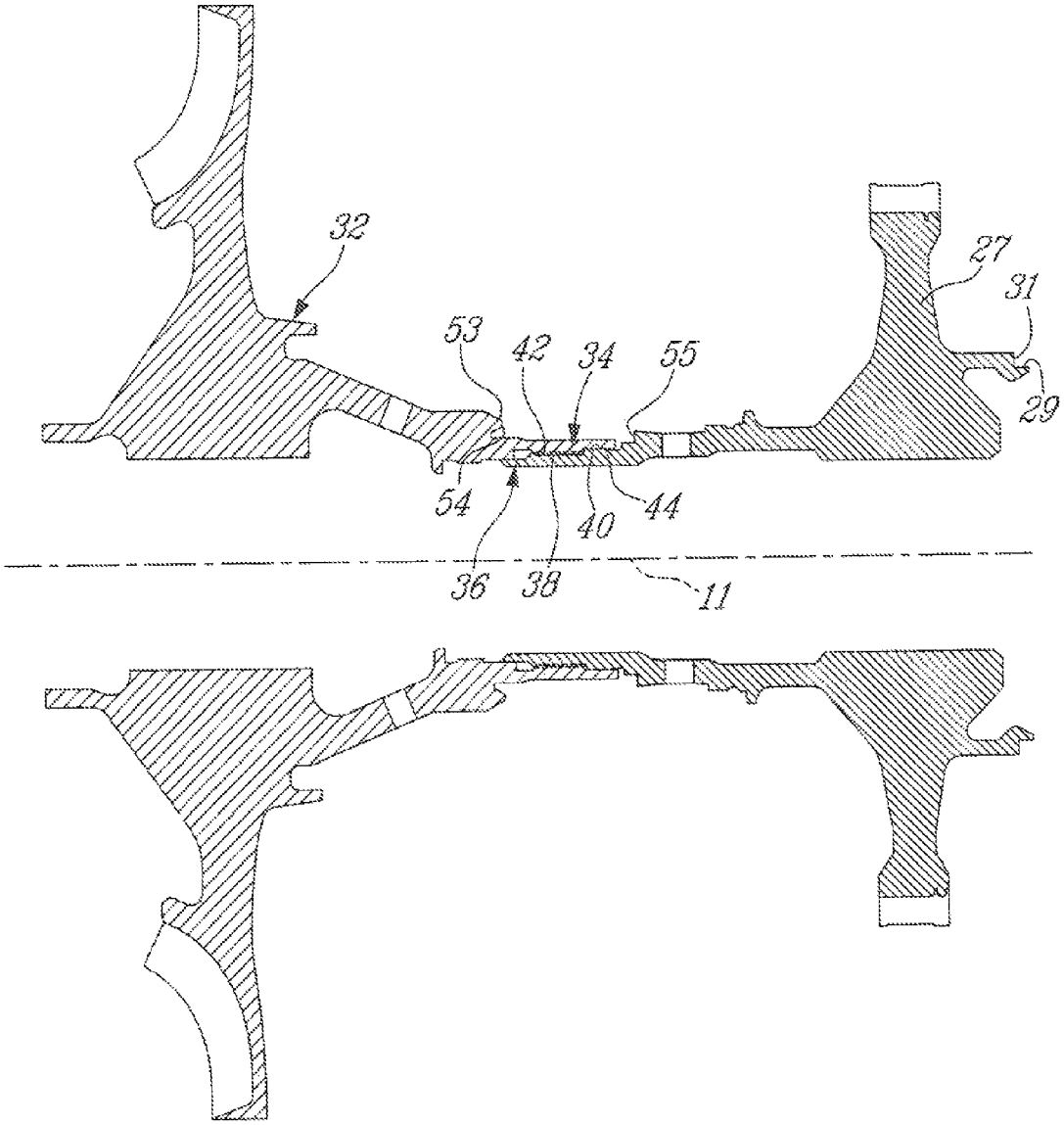
FIG. 3 is a cross-sectional view showing the detail of a two-stepped spigot connection between the HPC impeller and the first turbine disk of the HPT pack shown in FIG. 2.
Figure 3A:
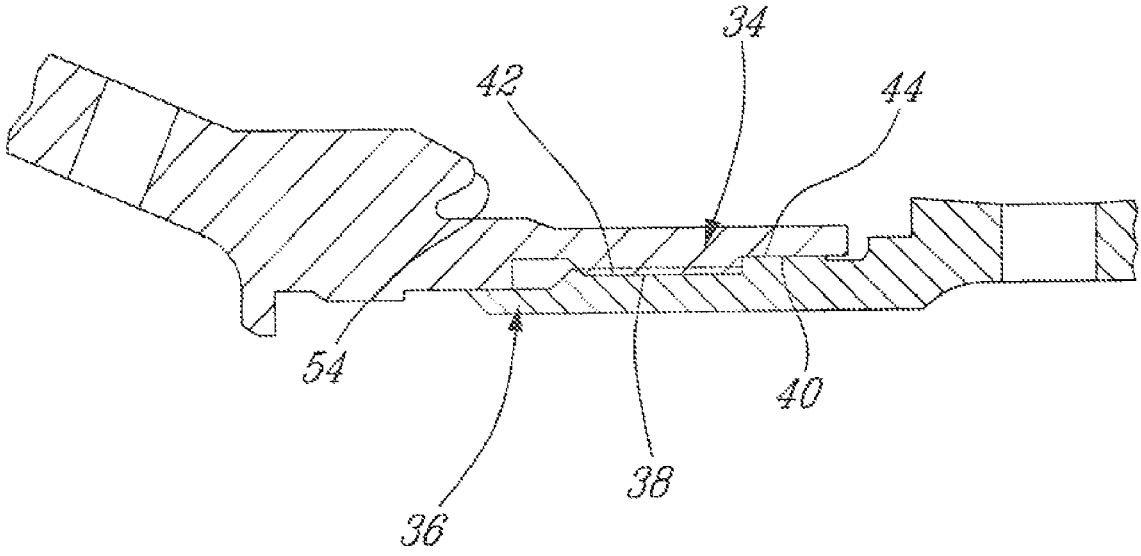
FIG. 3*a* is an enlarged view of the spigot connection shown FIG. 3.
Figure 4:
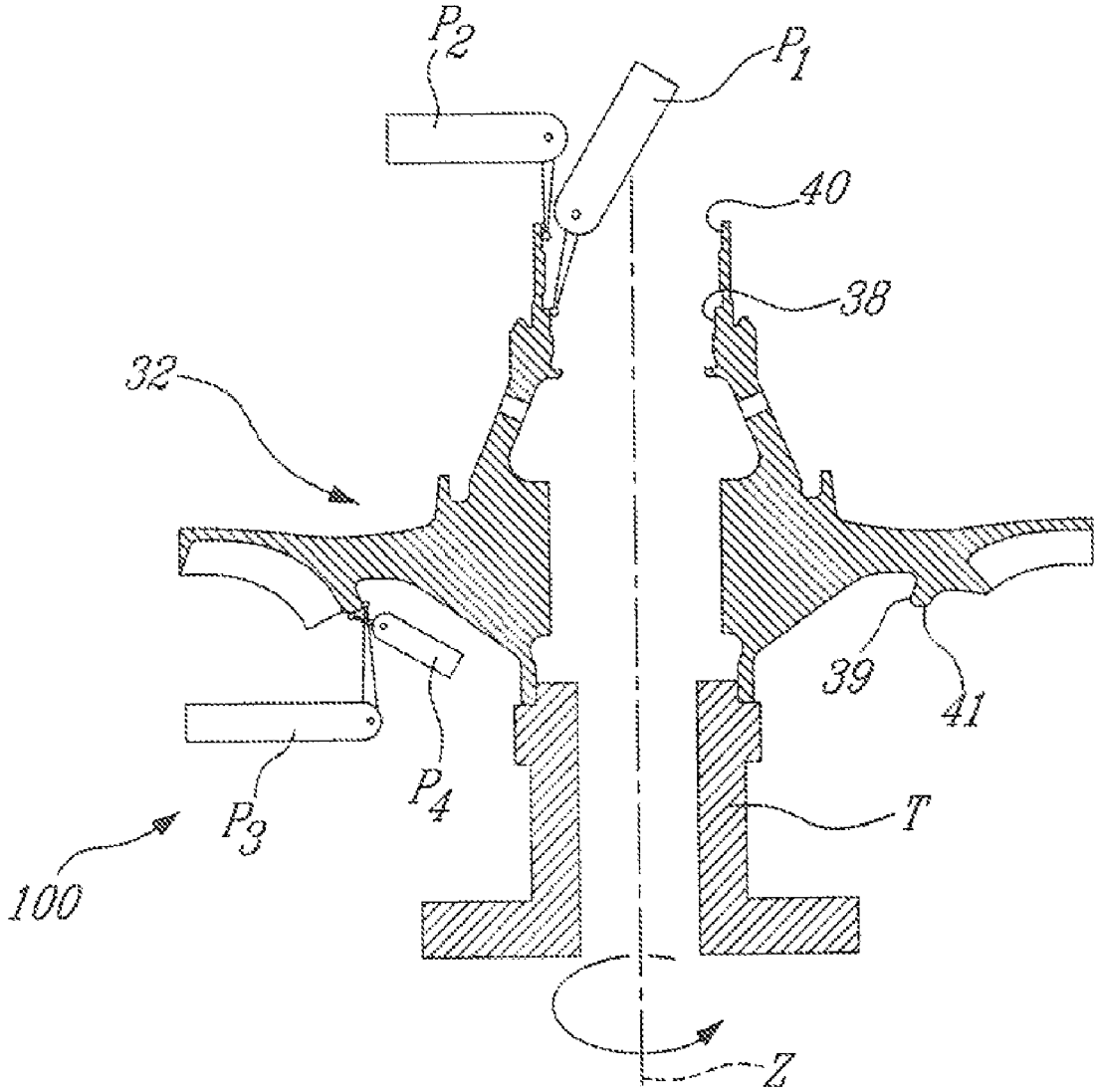
FIG. 4 is a schematic cross-sectional view of the HPC impeller of FIG. 3 mounted on a turntable for obtaining geometric parameters by means of a measuring system.

FIG. 2 shows an exemplary rotor assembly between the HPC pack 22 and the HPT pack 24 of the gas turbine engine 10. The HPT pack 24 includes first and second turbine disks 27 and 28 carrying respective circumferential arrays of radially extending blades 30*a* and 30*b* (however, it is understood that the HPT 24 may have any number of stages, including only one stage, i.e. only one disk). The HPT pack 24 further comprises a front cover plate 23 and a rear cover plate 25. As shown in FIGS. 2 and 3, the HPC pack 22 comprises, among other things, an impeller 32 (the exducer portion of which is shown in FIGS. 3 and 4) adapted to be assembled to other HPC rotor stages 20*a*, 20*b*, 20*c* (schematically shown in FIG. 1) to form the HPC pack or module. The impeller 32 is the last or downstream rotor component of the HPC pack 22, and provided on an aft side of the impeller 32 is a hollow spigot projection 34 adapted to tightly receive in mating engagement a corresponding spigot projection 36 of the first turbine disc 27. As best shown in FIGS. 3 and 3*a*, the spigot projection 34 of the impeller 32 in this embodiment has two axially-extending circumferential spigot, contact faces 38 and 40 respectively provided at first and second inside diameters of the impeller spigot projection 34. The spigot projection 36 of the HPT first disk 27 has two corresponding mating axially-extending circumferential spigot contact faces 42 and 44 respectively provided at first and second outside diameters of the spigot 36. The respective pairs of spigot contact faces 38, 42 and 40, 44 are adapted to telescopically engage by way of tight fit diameters. Mating in this way, the spigots dictate the relative alignment between the HPC pack 22 and HPT pack 24. In other words, the HPT pack 24 radial positioning (i.e. relative to the centreline) is based on the spigot alignment with the HPC pack 22. Deviations in spigot alignment result in deviations in alignment between the HPC and HPT packs.

Figure 2A:
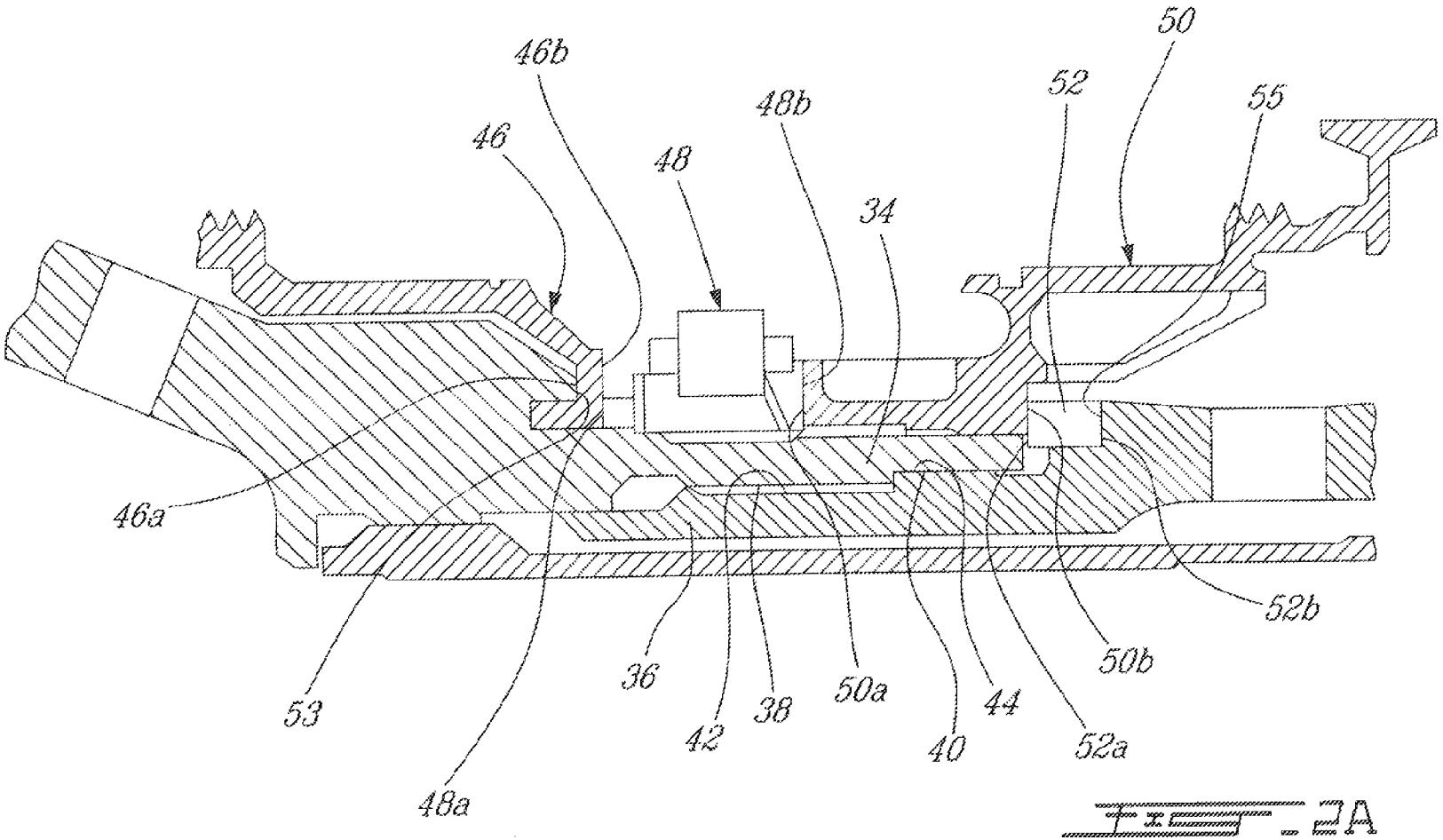
FIG. 2*a* is an enlarged view of a connection between the HPC and the HPT shown in FIG. 2.

As shown best in FIG. 2*a*, a plurality of intermediate components, sometimes referred to as a "clamp stack", is mounted (by clamping between the rotors, in this example) between the impeller 32 and the first turbine disc 27. More particularly, in the example of FIGS. 2 and 2*a* a front runner seal 46, a bearing 48, a rear runner seal 50 and a spacer 52 are axially positioned one next to the other between the impeller 32 and the first turbine disc 27. A tie shaft 54 extends axially centrally through the first and second turbine discs 27, 28, through the spigot joint and into the impeller 32 to apply a compressive clamping load to the rotor assembly. The tie shaft 54 is securely engaged at a forward end to the impeller 32. A nut 56 is threadably engaged on the aft end of the tie shaft 54 for axially clamping the clamp stack (i.e. front runner seal 46, the bearing 48, the rear runner seal 50 and the spacer 52) between a radially-extending circumferential rear abutment face 53 of the impeller 32 and a radially-extending circumferential front abutment face 55 of the first turbine disc 27. It is understood that any suitable tightening means could be used to axially press the intermediate components, the impeller 32 and the HPT pack 24 together.

Referring still to FIG. 2*a*, the front runner seal 46, the bearing 48, the rear runner seal 50 and the spacer 52 are each provided with respective mating radially-extending circumferential front-and rear abutment faces 46*a*, 46*b*; 48*a*, 48*b*; 50*a*, 50*b* and 52*a*, 52*b*. When clamped as described above, the front abutment face 46*a* of the front runner seal 46 is axially pressed against the rear abutment face 53 of the impeller 32. The front abutment face 48*a* of the bearing 48 is axially pressed against the rear abutment face 46*b* of the front runner seal 46. The front abutment face 50*a* of the rear runner seal 50 is axially pressed against the rear abutment face 48*b* of the bearing 48. The front abutment face 52*a* of the spacer 52 is axially pressed against the rear abutment face 50*b* of the rear runner seal 50. Finally, the front abutment face 55 of the first turbine disc 27 is axially pressed against the rear abutment face 52*b* of the spacer 52.

The rotor assembly shown in FIG. 2 is mounted within the engine coaxially with the engine centerline 11, defined by bearings 47 and 48 (see FIG. 1). It is desirable to minimize radial eccentricity of the assembly from the engine centerline 11, to reduce rotor imbalance and, thus, vibration during engine operation. Although each rotary component of a gas turbine engine is manufactured with precision, it remains that tolerance effects will result in components which, among other things, are slightly off-center relative to (i.e. lack concentricity with) the axis of rotation and which have less than perfectly parallel mating faces (i.e. faces are not square). The effect of such eccentricities relative to the nominal engine centreline which, if ignored, may cause radial rotor deflection (i.e. vibration) in use. Consequently, these imperfections increase the vibration amplitude of an assembly and can result in considerable unbalance in the gas turbine engine.

As mentioned, there are at least two types of geometric deviations due to tolerancing which are considered in gas turbine rotor balancing, namely (1) lack of concentricity of axially-extending surfaces with a datum axis, or the existence of an eccentricity between a geometric centre of the surface of interest and a selected datum (such as a shaft centreline), and (2) lack of parallelism of a radially-extending faces, or a deviation from parallel between a face and a selected datum face. Lack of concentricity is sometimes referred in the art (and herein) to as radial deviation, radial run-out, centerline deviation or perpendicular plane deviation. Lack of parallelism is sometimes referred to in the art (and herein) as plane deviation, bi-plane deviation or face squareness deviation.

Tolerance effects in individual components can be addressed during assembly to provide a more balanced assembly, such as by adding counterbalance weights, and or by adjusting the relative angular alignment of components (known as stacking) to offset the unbalances of individual components against each other, to provide a cancellation effect with respect to the overall assembly. For example, two components having radial deviations can be angularly aligned with the radial deviations positioned 180 degrees from one another, to minimize their cumulative effect. In multi-piece assemblies, balancing optimization becomes more complex.

One approach to stacking rotor components to minimize deviations is to build a rotor serially, component by component, positioning each relative component to an arbitrary datum defined by a first bearing centreline (it being understood that rotors assemblies are typically supported by at least two bearings, and thus the bearings may be used to establish a reference for the axis of rotation). The bearing centreline is typically established by a bearing centre and a bearing face, the centreline passing through the centre and extending perpendicular to the face. For example, the concentricity for each component is determined relative to the bearing centreline. A first component is then placed in position (in fact, or virtually), and its radial deviation from the desired datum is noted. A second component is then mounted to the first, and stacked relative to the first such that overall radial deviation of the assembly is reduced (i.e. one attempts always to build back towards the datum line, so to speak, ideally to yield a rotor assembly with a net-zero concentricity deviation once all rotor components are assembled). Unfortunately, this method does not work well in all situations, such as where rotor systems having a connection between two rotor assemblies, such as a spigotted or curvic coupling between an HPC pack and an HPT pack.

Figure 8:
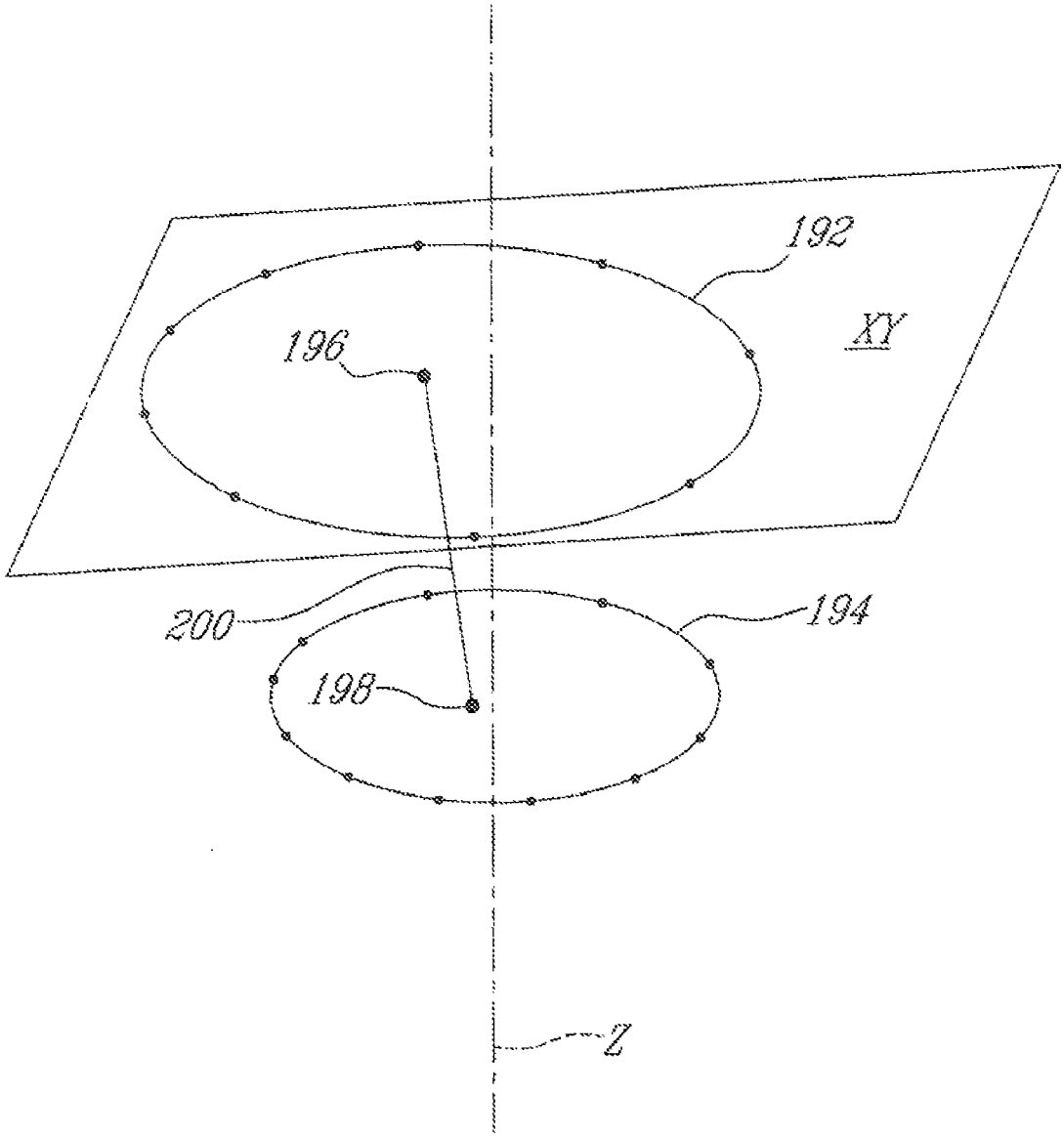
FIG. 8 shows a generic example of a possible spigot configuration.

For instance, a lack of concentricity or radial deviation of the axially-extending spigot contact faces 38, 40, 42 and 44 between the impeller 32 and the first turbine disk 27 may lead to an assembly unbalance if not taken into account when assembling the first turbine disk 27 to the impeller 32. For example, referring to FIG. 8, shown is a simplified single spigot connection Sp-Sp between two rotors R1, R2. Although the individual components R1 and R2 may have been individually optimized to as that they do not have significant radial eccentricities, if the spigots lack concentricity, there will be a resulting eccentricity in the final rotor assembly R1-R2.

Figure 9A:
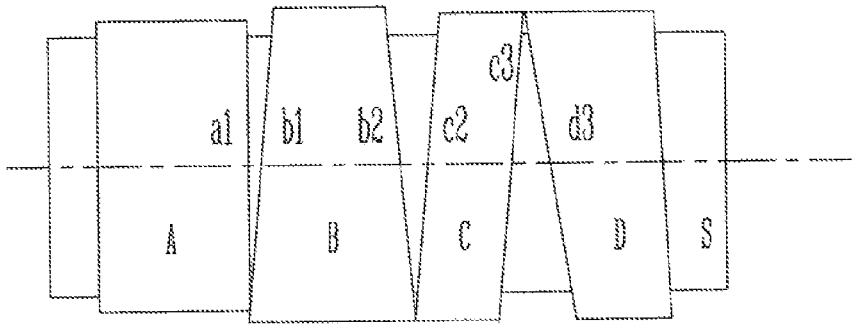
FIGS. 9*a*-9*c* show examples of possible stacking arrangement of adjacent shaft-mounted components.
Figure 9B:
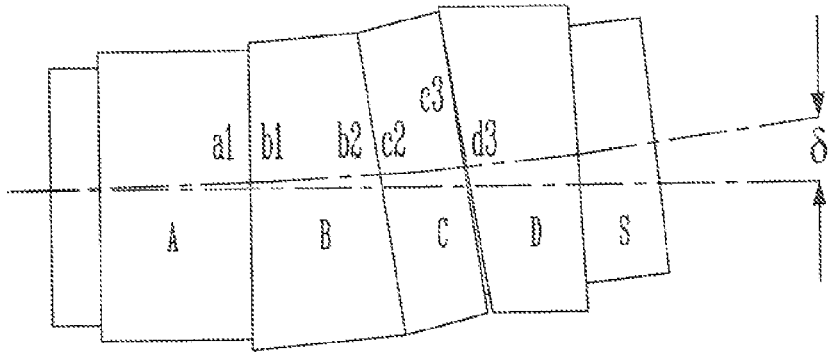

Furthermore, if the radially-extending abutment faces of a component are not parallel to one another, the interaction between the component and adjacent rotor components creates a mismatch between mating faces, which tends to cause unbalance. Referring to FIG. 9*a* and 9*b*, central shaft S has a plurality of components A, B, C and D with respective radially-extending mating faces a1, b1, b2, etc. which lack parallelism. Referring to FIG. 9*b*, when such components are clamped together under load, the shaft tends to deflect (δ) from the centreline in order to allow the mating faces a1, b1, b2, etc, to meet. Thus, the interaction between adjacent components is affected such that the center of mass of the assembly of FIG. 9*b* is offset or displaced from the axis of rotation or centreline.

Either of the examples of the preceding two paragraphs could result in a rotor having a displaced center of mass. A displaced center of mass in the turbine pack of the engine of FIG. 1, where the turbine overhangs the bearings, will perform an orbital trajectory around the desired axis of rotation during operation thus creating vibration. Typically, the greater the displacement, the greater the vibration.

As mentioned, rotor assembly unbalance can be minimized by adjusting the stacking angle of each component in relation to the other rotor components, so as to cumulatively minimize the unbalancing effect of the lack of concentricity and the non-parallelism of the mounting ends (also referred to herein as radial abutment faces) of the rotor components. The stacking angle of each component is adjusted by rotating the component relative to adjoining components) about the centerline axis in the rotor stack. By optimizing the relative stacking angles for each component, the overall balance of the rotor can be optimized, by aligning the individual components so that unbalances are subtractive, rather than additive, tending to cancel one another out. This can result in an overall assembly with a minimal possible imbalance for a given set of components.

Figure 9C:
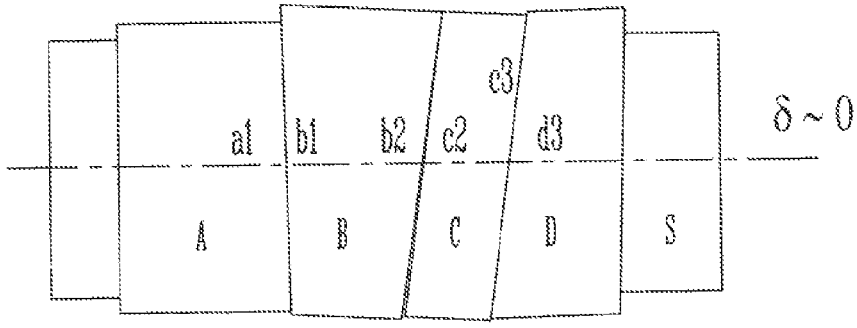

Referring again to FIGS. 9*a*-9*b*, it has been found that shaft deflection is proportional to the cumulative tolerance error in a clamp stack between two rotor assemblies (or any other reference faces). It has also been found that stacking the components clamped between two rotor assemblies significantly improves the geometry and hence measured out of balance of the overall rotor assembly. Referring to FIG. 9*c*, if one considers the relative lack of parallelism of the various mating faces a1, b1, b2, etc., an optimal arrangement of the faces may be found to minimize the net deflection (δ) of the assembly, once a clamping load is applied. To do so, conceptually speaking, the faces a1 and d3 of the outside components A, D (in this example) can be thought of as defining a space of certain shape and the remaining components (B, C in this example) are then arranged relative to one another and relative to components A, D, to fill the space as neatly as possible, so to speak. In other words, the components A-D are preferably stacked (i.e. angularly aligned) so that the mating faces (a1-b1, b2-c2, etc.) are as parallel as possible to one another within the given selection of components, all with the goal of providing a "best fit" of components within the space/shape defined by the outer or boundary surfaces a1 and d3. It will be understood that the selection of components may also be altered, for example by substituting a component D with an unfavourable face characteristic for another component D "off the shelf", to arrive at a more optimum face alignment, Although the above example, for illustration purposes assumes that the components A, D will define a pre-selected space within which the remaining components will be aligned to "fill", it will be understood that the relative alignment of components A, D will also be considered an optimized, to provide the best possible shape to which the remaining components are best suited. Thus, as can be seen from FIG. 9*c*, an alignment of components is possible wherein face squareness error is minimized for the assembly, thereby reducing imbalance.

A rotor balancing example will now be considered for the gas turbine engine described above. As will be seen hereinbelow, numerous geometric parameters from the above described components of the high pressure rotor assembly are considered in the present technique in order to obtain the optimized component stacking angles that would provide the minimum rotor assembly unbalance, resulting in less vibration. Accordingly, different geometric inputs are required, such as 1) the parallelism of the radially-extending faces of the HPC and HPT components and of the intermediate parts (i.e. front inner seal 46, bearing 48, rear runner seal 50 and spacer 52) located between the HPC and HPT packs, 2) the concentricity of the HPC and HPT components, and 3) HPC impeller two spigot alignment geometry when the HPC pack is in an assembled state (as will be discussed further below with reference to FIG. 6). The calculations and optimizations discussed further below are preferably processed by a computer, which employs various computer programs to compile the collected component geometric data and execute iterative processes to generate the best stacking optimization possible (i.e. the optimal stacking angles of the components) of the high pressure rotor assembly.

Figure 7:
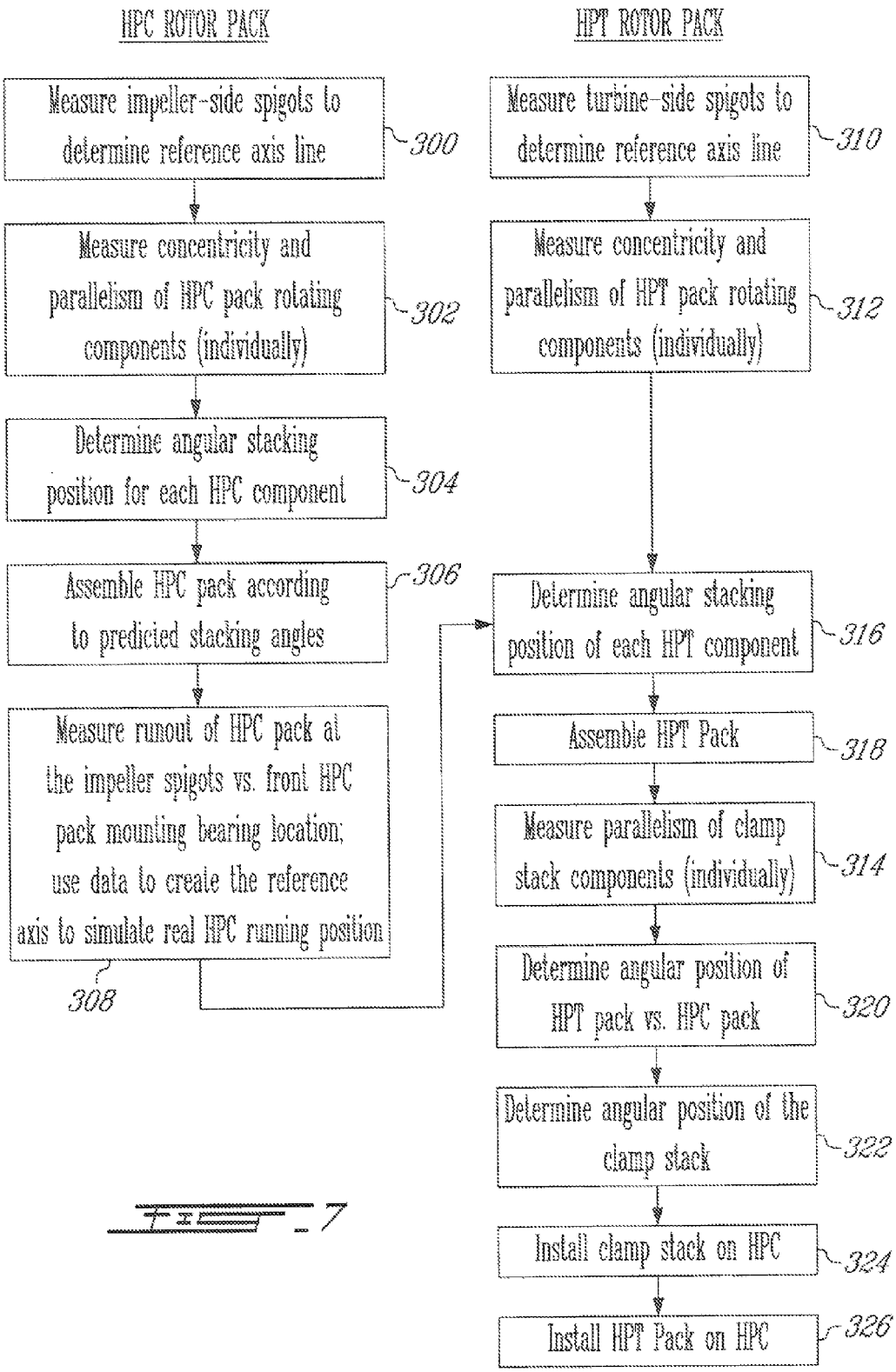
FIG. 7 is a flow chart showing a method of balancing an assembly or rotary components including first and second main components and intermediate components.
Figure 8:
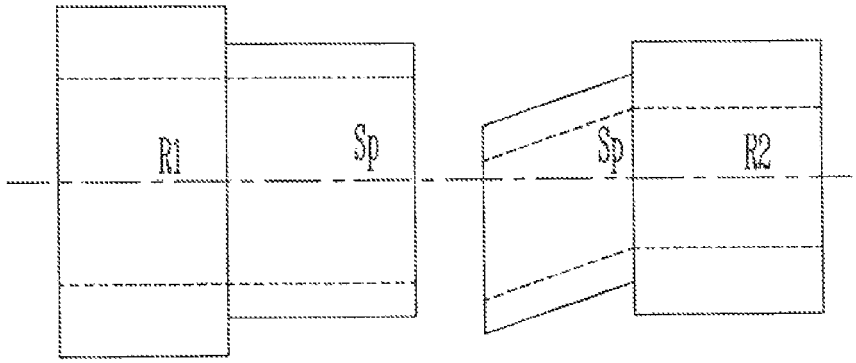

Now referring to FIGS. 4 to 7, we will see in details how the HPC stack 22, the HPT stack 24 and the HPC-HPT assembly are balanced. FIG. 7 depicts a method according to the present teachings.

Referring more particularly to FIG. 4, there is shown a measuring system 100 having a rotary table T and a plurality of probes P1-P4 operatively connected to a programmable control system (not shown) which measures and processes the individual displacement readings from probes P1-P4. Probes P1-P3, in this set-up, are used to measure the concentricity, whereas probe P4 is used to measure the parallelism of a front face 41 of the exducer of impeller 32. A datum or imaginary axis of rotation is determine using data collected by probes P1 and P2, and the output of the machine is the concentricity and parallelism provided by probe P3 and P4 respectively relative to the datum created by P1 and P2. The same approach applies to other rotor components. The approach will now be discussed in detail.

Balancing of this rotor preferably begins with the impeller 32. The exducer of the HPC impeller 32 is mounted front face down on the rotary table T and the probes P1-P4 are positioned on predetermined surface points on the HPC impeller 32. Particularly, as indicated in step 300 of FIG. 7, probes P1 and P2 are respectively used, to obtain geometric data on the concentricity of the HPC impeller 32 at the spigot contact surfaces 38 and 40 (it being understood that, at least initially, concentricity is measured relative to an axis of rotation of rotary table T). The probes P3 and P4 are used to obtain geometric data on the front side of the impeller 32. Probe P3 provides geometric data on the concentricity of the front inner diameter surface 39 of the exducer of impeller 32, whereas probe P4 provides geometric data on the parallelism of the front face 41 of the exducer of HPC Impeller 32. Surface 39 and face 41 matingly engage the upstream adjacent HPC component, in this case the inducer of impeller 32 (not shown) and, thus, need to be taken into consideration in the determination of the HPC component stacking angles.

More specifically, measurement is done as follows. The measuring system 100 rotates the rotary table T, causing the exducer of HPC impeller 32 to rotate about the axis of rotation Z. The probes P1-P4 remain stationary and in contact with the surfaces/faces of the exducer of HPC impeller 32 as the latter rotates. The probes P1 and P2 in contact with the inside spigot contact faces 38 and 40 record geometric data on the surface concentricity variations. More particularly, the probes P1 and P2 record the distance of each spigot contact face 38 and 40 from the axis of rotation Z at a series of points (i.e. angular locations). The measured points are preferably provided almost continuously around the circumference, to provide a multiple data points and thus improve the accuracy of measurement around the entire circumference. In a 3-dimensional coordinate system where the Z-axis is defined along the axis of rotation Z as shown in FIG. 6, each probe P1-P3 records a series of data points in an X-Y plane around the circumference for a given Z value.

The data points representing spigot concentricity, recorded by probes P1 and P2, are used to define a primary datum axis for the rotor assembly, as set forth by method step 300 of FIG. 7. More specifically, the data points recorded by each probe P1, P2 may be connected to form respective circular formations 192 and 194 in the X-Y planes, as shown in FIG. 6. Theoretically, for a perfectly concentric component, the circular formations 192 and 194 would be perfectly centered about the Z-axis. However, in practice even the most precisely manufactured components have a slight eccentricity. Therefore, the primary datum axis is determined by connecting the center points 196 and 198 of the two circular formations 192 and 194 to provide a primary datum or reference axis 200. The reference axis 200 defines the primary datum for the HPC components stacking (i.e. the stacking of the remaining HPC stages 20*a*, 20*b*, 20*c* and the inducer (not shown) of impeller 32 to the exducer of impeller 32), Spigot, contact surfaces 38 and 40 are thus used to define a primary datum or reference axis 200 for balancing of the HPC pack 22. The selection of this primary datum will ultimately result in a better assembly stacking with the HPT stack, as will be seen below.

Once the HPC primary datum or reference axis 200 has been determined, the respective surfaces and faces of each other HPC components (e.g. the inducer and stages 20*a*, 20*b* and 20*c*) of the HPC pack 22 are preferably measured in a similar manner, in terms of concentricity and/or parallelism as described above, to acquire the relevant measured data as defined by method step 302 of FIG. 7. The measured data are then referenced back to the primary datum/reference axis 200 to determine the best HPC component stacking angles, considering the whole HPC assembly (method step 304 in FIG. 7). This determination can be made in any suitable manner, however, in the preferred embodiment a computer, supplied with the measured concentricity and parallelism data, makes the determination in the following manner. Each geometric parameter, namely the parallelism and the concentricity of each component are used to produce a resultant vector representative of an eccentricity of the component. The eccentricity vectors of the rotating HPC components are added together to provide a final resultant vector that expresses the (lack of) concentricity of the HPC stack front journal end 47 in relation to the two impeller spigots (in this case) that are located at the back (downstream) end of the HPC stack. A numerical iteration process is then preferably used to converge toward a final solution of component angular positions which minimizes the magnitude of the vector. The solution creates the final eccentricity vector result that minimizes the HPC end-to-end eccentricity. Commercially available software can be used to process the iterative calculation.

The components of the HPC pack 22, including the impeller 32, are then physically assembled according to the calculated stacking angles, as set forth in method step 306 of the flowchart shown in FIG. 7. Depending on joint geometry, where a finite number of positions are available between adjacent components, the stacking angles may require to be rounded off to the nearest bolt hole location. The HPC pack 22, that is the assembled components 20*a*, 20*b*, 20*c* and 32, is then installed front end down on the rotary table T for verifying the actual concentricity deviation of the assembly (i.e. by measuring the concentricity deviation of the two spigot contact faces 38 and 40 of the impeller 32 relative to the rotary table axis), and the proper alignment and seating of the HPC rotor components assembled together, as indicated in step 308 of the flow chart sown in FIG. 7. Probes P1 and P2 are positioned in contact with the two spigot contact faces 38 and 40, whereas probes P3 and P4 are respectively used to measure the parallelism and the concentricity at the front journal end of the HPC stack 22, the front journal end being the interface between the front most HPC component 20*a* and the front end bearing 47. The parallelism and concentricity measurements obtained by P1-P4 are then compared with the predicted values to ensure that they correlate. As will be seen herein below, the measured deviations and concentricity angles (i.e. vectors indicating the magnitude and angle of the concentricity deviation in reference to the reference center line described by the front and rear bearings center line of the HPC stack) of the assembled HPC pack 22 will also be considered during the balancing optimization process of the HPT pack 24 and the clamp stack (front runner seal 46, bearing 48 and rear runnel seal 50). The center line created by the back end impeller's spigots 38, 40 is compared to the center line described by the front and rear bearings of the HPC stack. The difference in the two center lines determines the concentricity off-set of the impeller spigots 38, 40 in the engine running position (step 308). This concentricity off-set vector information is used to position the HPT pack in order to minimize the overall HPT pack unbalance in reference to the centerline defined by the front and rear bearings of the HPC stack. In other words, the HPT components will be positioned in such a manner that they will counteract the concentricity offset created by the HPC impeller spigots.

Figure 5:
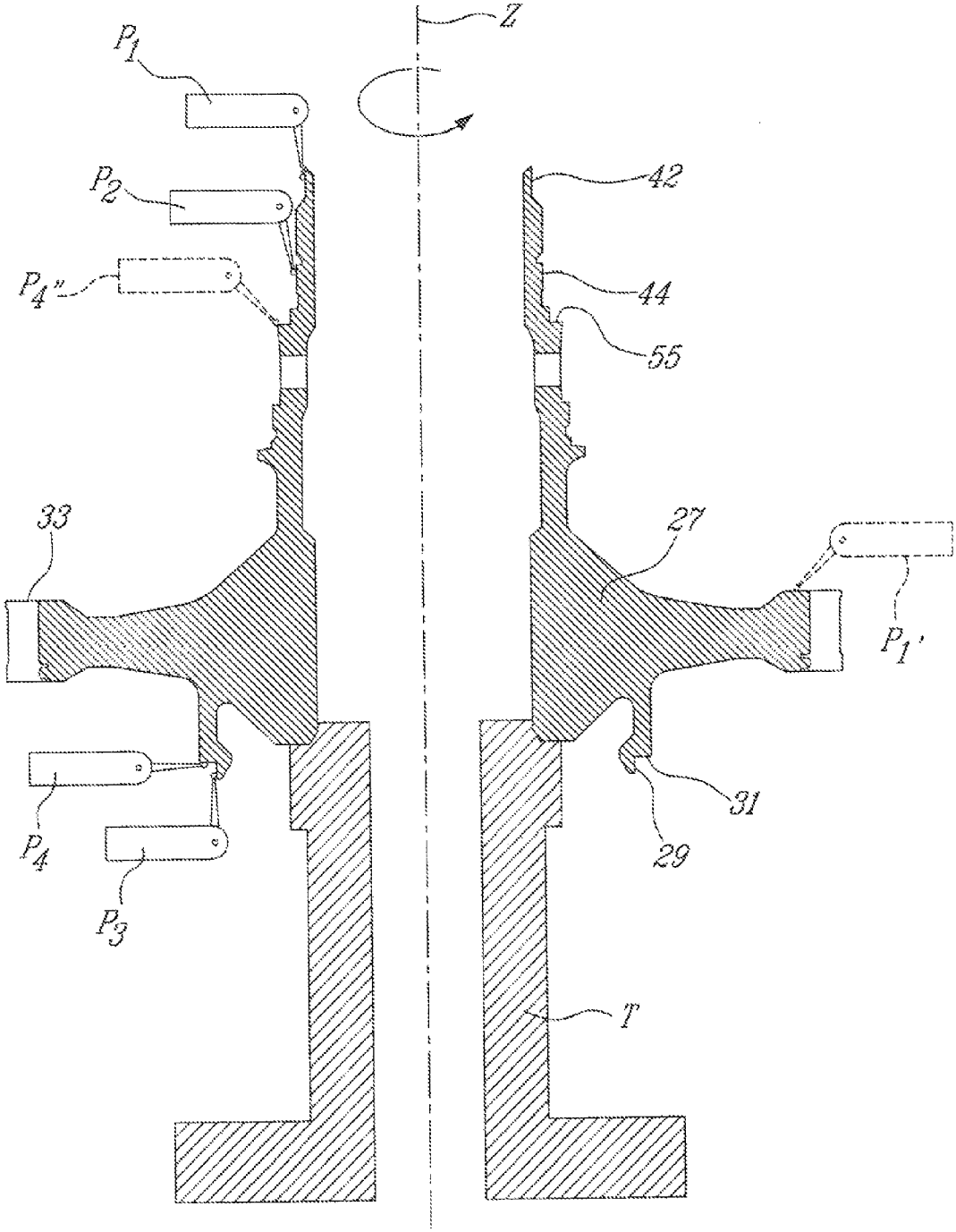
FIG. 5 is a schematic cross-sectional view of the first, turbine disk of FIG. 3 mounted on a turntable for obtaining geometric parameters by means of the measuring system.

Balancing of the HPT pack will now be described. As shown in FIG. 5, the HPT first disk 27 is installed rear face down on the rotary table T and is measured, in a similar manner as described above with reference to the exducer of impeller 32, to acquire concentricity and parallelism data, as follows. Just as for the HPC pack 22, the measurement of the concentricity deviation of the spigot contact surfaces 42 and 44 is used to establish a primary datum (e.g. see a reference axis 200 of FIG. 6) for the HPT components stacking. This corresponds to step 310 of FIG. 7. Particularly, probes P1 and P2 obtain geometric data on the concentricity of the high pressure turbine first disk 27 at the spigot contact faces 42 and 44. Probe P3 obtains data on the concentricity of an annular aft flange 29 of the first disk 27 on which the second turbine disk 28 is fitted, as shown in FIGS. 2 and 2*a*. Probe P4 provides geometric data on the parallelism of a rear abutting face 31 of the first disk 27 and against which the second turbine disk 28 is axially mated.

In a second probe set-up configuration, as shown in dotted outline in FIG. 5, further measurements are taken. In particular, probes P2 is removed and probe P1' is repositioned to obtain geometric data on the parallelism of front face 33. The first disk 27 is then rotated by the rotary table to obtain a second set of geometry data on the first disk 27 from the measurements of probes P1', P3 and P4. In this configuration, probes P1' and P4 permit to measure parallelism deviation between front face 33 and rear face 31. Rear face 31 is used as the reference for measuring the deviation of front face 33.

Still referring to FIG. 5, the probes are then set in a third configuration, wherein probes P1 and P2 are used to obtain geometric data on the concentricity of the high pressure turbine first disk 27 at the spigot contact faces 42 and 44 (like in the first probe configuration), P3 is removed while probe P4" is used to obtain geometric data on the parallelism of the front abutment face 55 (which will be placed in mating engagement with spacer 52 (see FIGS. 2/2*a*) in the final assembly). Probe P3 is not used in this third probe set-up.

Figure 10:
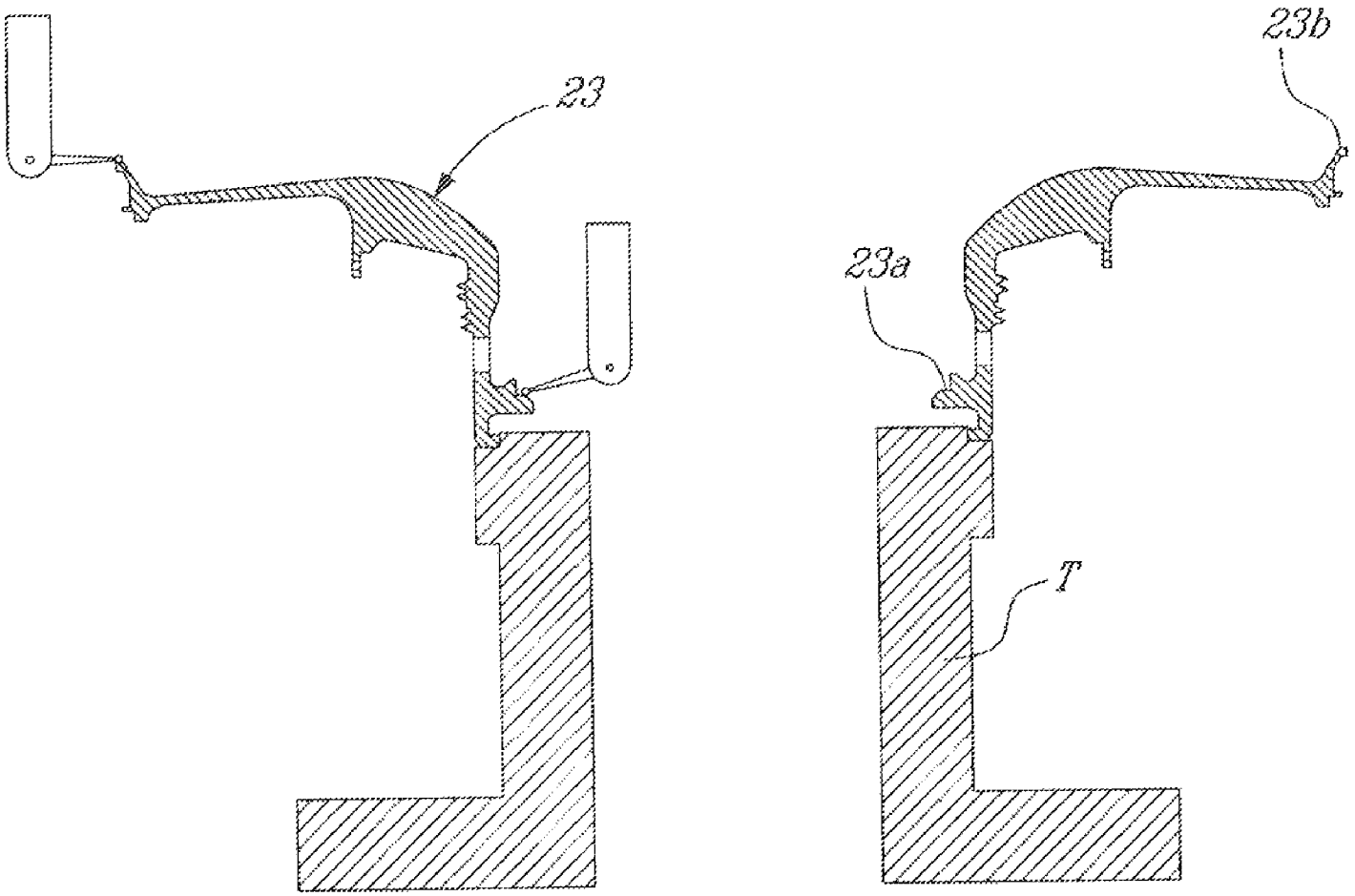
FIG. 10 is a schematic cross-sectional view of a turbine cover plate mounted on a turntable for obtaining geometric parameters by means of the measuring system.

After having so measured the turbine disk 27, the concentricity and parallelism of the other components of the HPT pack are measured as indicated in step 312 of FIG. 7. For instance, as shown in FIG. 10, the front cover plate 23 is installed on the rotary table T to obtain geometric data on the parallelism of the axially front and rear mating faces 23*a* and 23*b* relative to the first turbine disk 27 (see FIGS. 2/2*a*). Rear face 23*b* is used as the reference or datum surface to evaluate the face axial run out (i.e. parallelism). The collected data on the axial face parallelism deviation between the front and rear mounting ends of the first disk 27 and the front cover plate 23 (i.e. between face 23*a* and face 33) are then preferably used to calculate (e.g. by computer) the optimal angular stacking position of the front cover plate 23 relative to the first disk 27.

Though not depicted in the Figures, geometric data are also collected on the second turbine disk 28, in a manner similar to that described above with reference to FIG. 5. More particularly, the second turbine disk 28 is installed front face down on the rotary table T and probes are appropriately positioned to measure the parallelism of front and rear mating faces 28*a* and 28*b*, and the concentricity of faces 28*c* and 28*d* (see FIG. 2). Faces 28*a* and 28*c* are respectively used as the datum face and datum inside diameter to evaluate the face perpendicular plane deviation and the centerline deviation.

Likewise, as discussed above with reference to FIG. 10, the rear cover plate 25 is installed on the rotary table to obtain geometric data on mating faces/surfaces 25*a*, 25*b*, 25*c* and 25*d* (see FIG. 2) in order to determine the parallelism and concentricity of these surfaces/faces, as described hereinbefore. Face 25*a* and surface 25*c* are respectively used as the datum face and datum inside diameter to determine the parallelism and the concentricity of the coverplate.

The deviations in concentricity and parallelism measured for the rear cover plate 25, the second turbine disk 28 and the previously-stacked front cover plate-first turbine disk assembly are used, together with the previously measured deviations and concentricity angles (i.e. vectors indicating the magnitude and angle of the concentricity deviation) of the assembled HPC pack 22 to calculate the optimized angular stacking angles between the previously-stacked front cover plate-first turbine disk assembly, the second turbine disk 28 and the rear cover plate 25 (step 316 in FIG. 7). As described before, preferably this is done by iterative computer process, in which eccentricity vectors are optimized to a minimal size.

This process of stacking discs and coverplates recognizes that the disc and coverplate are simply another "stack" which are to be considered in the rotor assembly, since eccentricities between the coverplate and the disc can tend to bend the assembly. Hence, this "stack" is also preferably considered in a comprehensive stacking analysis of the rotor assembly.

The computer also preferably predicts the total radial (concentricity) deviation of the HPT stack (i.e. between HPT spigot and rear coverplate) for the computed optimized stacking, angles, which will be used later. The additional input of the actual deviations of the HPC pack 22 (measured earlier at step 308) allows the computer to consider the effect of the alignment of the two impeller spigot faces 38 and 40 relative to the centerline axis 11 defined by bearings 47 and 48. As mentioned hereinbefore, the concentricity off-set of the impeller spigots 38, 40 relative to the center line defined by bearings 47 and 48 is used to position the HPT pack in order to counteract the concentricity offset created by the HPC impeller spigots.

Figure 11:
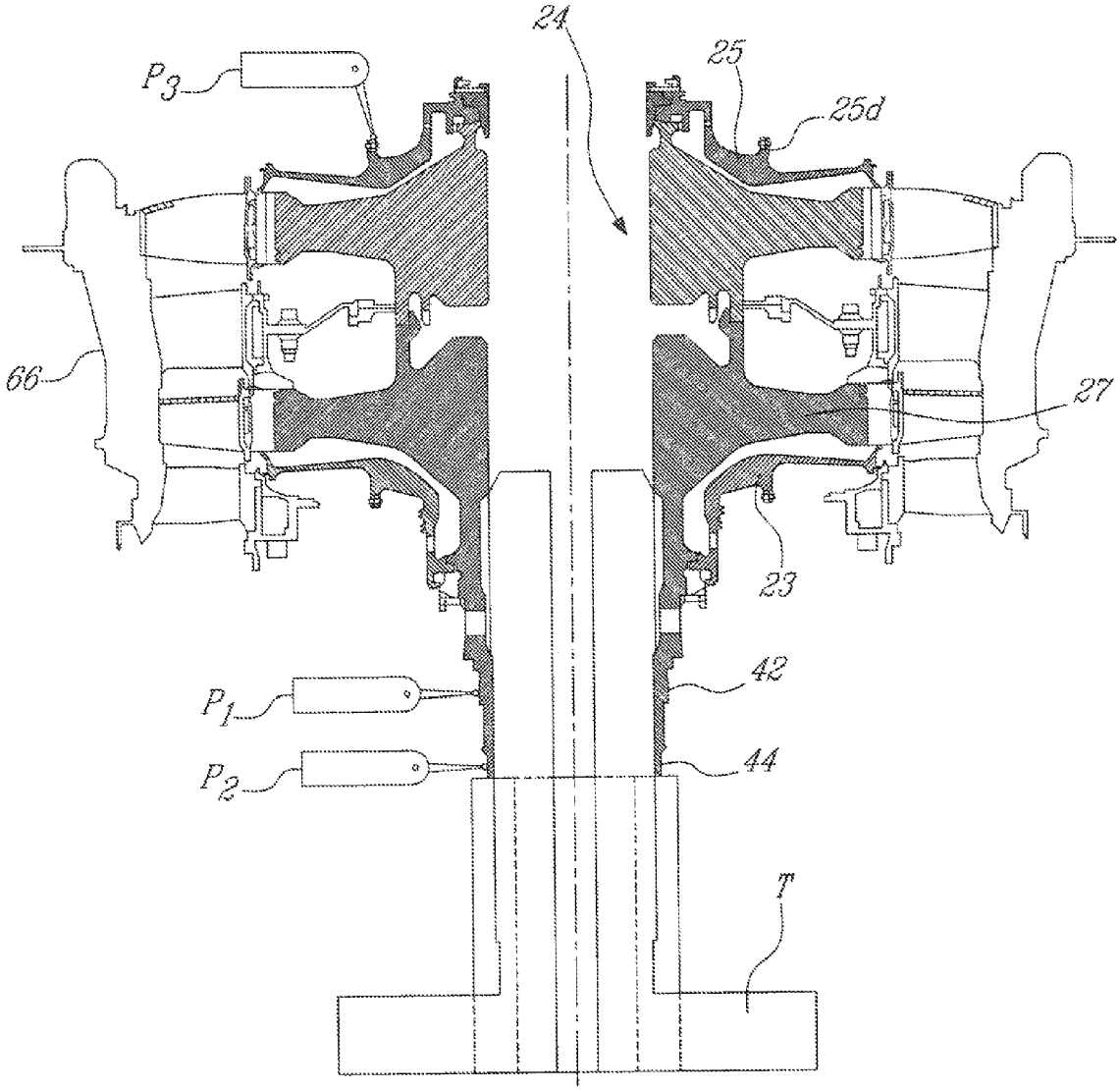
FIG. 11 is a schematic cross-sectional view of the HPT pack-turbine shroud housing assembly mounted on a turntable for obtaining geometric parameters by means of a measuring system.

The HPT stack 24 is then assembled (step 318 in FIG. 7) according to the calculated optimized stacking angles and the assembly is mounted in the turbine shroud housing 66. Thereafter, as shown in FIG. 11, the HPT stack 24 and the turbine shroud housing 66 are installed front end down to the rotary table T. A pair of probes P1, P2, is provided to measure the centerline deviation of the spigot surfaces 42 and 44 at the front mounting end of the first turbine disk 27, in a manner similar to as described above. A third probe P3 is provided for measuring the concentricity deviation of surface 25*d* of the rear cover plate 25. These geometric data obtained are compared and validated with the concentricity values predicted for the HPT pack, as discussed above in the preceding step.

In the next step corresponding to step 314 in FIG. 7, each of the intermediate components or clamp stack (i.e. the front runner seat 46, the bearing 48, the rear runner seal 50 and the spacer 52) between the HPC pack 22 and the HPT pack 24 is also individually measured (not shown) to obtain data on the parallelism between their respective front and rear abutment faces. In this way, the face axial run out (i.e. deviation from parallel) of each intermediate component is individually ascertained.

Then, to establish the stacking angle of the HPT pack 24 relative to the HPC pack 22 as set forth in step 320 in FIG. 7, the measured face axial run out of the spacer 52, the output of the turbine pack optimization computer program (i.e. the angular indexation of the component) and the measured deviations of the assembled HPC pack 22 are used (e.g. by the computer) to establish the stacking angle of the overall HPC-HPT assembly. The spacer is installed first for ease of assembly only and could, thus, be not considered in the determination of the angular position of the HPT pack vs. the HPC pack. Referring again to FIG. 3*a*, when the overall HPC-HPT assembly is assembled and stacked according to the predicted stacking angle, it will be appreciated that the shoulder 53, of HPC spigot 34 and the shoulder 55 of the HPT spigot 36 define an envelope in which the clamp stack will ultimately be assembled.

The next step corresponds to step 322 in FIG. 7 and relates to the stacking of the clamp stack. As discussed above with reference to FIG. 9*c*, preferably the parallelism of faces is considered and arranged so as to provide a "best fit" (i.e. minimize face error) to the envelope defined between spigot shoulders 53 and 55. However, in this gas turbine embodiment, since the spacer 52 effectively forms a part of the HPC-HPT assembly, the clamp stack envelope is in fact defined by HPC spigot shoulder 34*b* and front face 52*a* of spacer 52, since the stacking angle of the spacer 52 has already been selected with reference to the stacking of the HPT pack to the HPC pack. The measured parallelism deviations of the front runner seal 46, the bearing 48 and the rear runner seal 50 are therefore used (e.g. by the computer), together with the measured deviations of the assembled HPC pack 22, the output of the turbine pack optimization program and data "simulating" the effect of the high pressure turbine first disk 27 front face 55 squareness (i.e. perpendicularity) relative to the spigot surfaces 38, 40, 42 and 44. In other words, The computer provides the HPT stack assembly indexing position relative to the HPC stack and therefore predicts the envelope defined between the HPC spigot shoulder 53 and front face 52*a* of spacer 52. The computer program determines (e.g. by an iterative process of the type described above) the best stacking angles of the front runner seal 46, the bearing 48 and the rear runner seal 50 to minimize face error within the envelope defined between HPC spigot shoulder 53 and front face 52*a* of spacer 52. The next and final step in balancing is to stack each component of the assembly in the determined stacking angles. Using the calculated data, the clamp stack components (front runner seal 46, the bearing 48 and the rear runner seal 50 and spacer 52) are assembled to the HPC pack (step 324 in FIG. 7), and the HPT pack is installed on the HPC (step 326 in FIG. 7) to provide an overall HPC-HPT assembly. Measurements are made to verify that the predicted deviations and run-outs have been obtained in fact.

The method of balancing an assembly of rotary components exemplified herein advantageously helps improve gas turbine engine vibration acceptance. As a result, re-test costs are reduced. As seen herein above, the geometric data obtained by measuring each component of the high pressure rotor assembly are considered using spigot interfaces as primary datum for both the HPC pack 22 and the HPT pack 24. Although the use of a spigot connection is discussed, the approach applies as well to a rotor assembly having a curvic coupling between HPC and HPT—the skilled reader will appreciate that, rather than using two concentricity measurements to establish the primary datum (i.e. see FIG. 6), a concentricity and squareness (parallelism) measurement of the curvic coupling could be used instead to establish the primary datum. Concentricity and squareness of the curvic coupling can be measured in any suitable fashion, including using known techniques for doing so.

The method of balancing an assembly of rotary components described herein considers all possible component stacking positions, within each rotor stack and within the overall assembly, to achieve optimum unbalance of the assembly as a whole. Thus, the optimized stacking position does not necessarily position the component in its most balanced (i.e. concentric and parallel) position when considered only in context of its closest neighbours, but rather represents the optimized position to provide the most balanced (i.e. concentric and parallel) position of the entire assembly. Rather, when all the components of a given assembly are considered as a whole, the result is optimal.

As can be seen from the above description, preferably the balancing of the HPC and HPT packs is optimized separately for each pack, and the assembly of the two is also optimized to ensure the overall rotor assembly is also optimized. Relative to a rotor where the entire assembly is balance/optimized at once as a whole, this technique permits, for example, better interchangeability of HPT packs should it be desirable to remove an HPT pack from an engine and replace it with another. By analyzing the HPC and HPT separately, and then together as an assembly, this type of interchangeability is facilitated without compromising rotor balance.

The above description is exemplary only, and changes may be made. For example, instead of using an iterative process based on all the components characteristics to find the optimum stacking optimization angles, other techniques may be used. For example, a less rigorous optimization method may look at finding the best stacking angles by optimizing one part at a time and not considering the whole assembly. It is also understood that the methodology can be used for any other suitable rotor constructions, such as other turbine rotors, and is not limited to the specific rotor or coupling embodiments discussed here.

The present stacking optimization method, could be applied to two rotor components (e.g. an HPC and an HPT) having a single spigot interface, and is not limited to the double spigot interlaces as described above. As mentioned above, a curvic or other type of coupling may also be used. According to the present teachings, the rotor-rotor connection simply dictates a certain alignment of the two rotors which should be considered in balancing such a rotor. For instance, the stacking position between the first and second rotors could instead by optimized by angularly positioning the second rotor (e.g. HPT) so as to off-set the eccentricity of the first rotor (e.g. HPC) resulting in the lowest possible unbalance between the two. Thus, the primary datum established by the first rotor is the basis for the optimization. In short, the reference point could be the turbine stack as opposed to the HPC stack. Once the optimal stacking positions of the first and second main components have been established, the parallelism of the mating faces of the first and second main components and all the intermediate components can be considered to determine the combination of stacking positions that yields the lowest assembly unbalance.

Therefore, the above description is meant to be exemplary only, and one skilled in the art will recognize that changes may be made to the embodiments described without departing from the scope of the invention disclosed. Still further examples are: the method of balancing an assembly of rotary components may be applied to any suitable rotor assembly; and although it is preferred to use both the concentricity and parallelism data in determining optimal stacking as described above, the two need not be used together, and may be used individually or in combination with other rotor measurements. Still other modifications which fall within the scope of the present invention will be apparent to those skilled in the art, in light of a review of this disclosure, and such modifications are intended to fall within the appended claims.

What is claimed is:

1. A method of balancing a rotor assembly comprising first and second rotors and a stack of intermediate components clamped in axial series between the first and second rotors, the first and second rotors being respectively provided with the first and second telescopically mating axially-extending circumferential faces defining a coupling, the method comprising: establishing a primary datum axis at said coupling, referencing said first and second rotors to said primary datum axis, determining a relative angular position of the first and second rotors, the so angularly positioned first and second rotors respectively providing first and second radially-extending reference faces defining an axial space therebetween for receiving the stack of intermediate components, determining a stacking angular position of each of said intermediate components using geometrical data on said intermediate components and said first and second radially-extending reference faces, and assembling the rotor assembly using the relative angular position of the first and second rotors and the stacking angular positions of the intermediate components.

2. The method defined in claim 1, wherein the geometrical data comprises data on parallelism of axially mating radially-extending faces of said intermediate components.

3. The method defined in claim 1, comprising obtaining data on the concentricity of said first and second telescopically mating axially-extending circumferential faces in the determination of the relative angular position of said first and second rotors, the concentricity being determined relative to the primary datum axis.

4. The method defined in claim 1, therein said coupling comprises first and second axially-extending circumferential spigot contact surfaces provided on the first rotor for respective engagement with corresponding third and fourth axially-extending circumferential spigot contact surfaces provided on the second rotor, and wherein establishing the primary datum comprises measuring the concentricity of said first, second, third and fourth axially-extending circumferential spigot surfaces.

5. The method defined in claim 4, wherein said first rotor includes a stack of compressor components, said second rotor including a stack of turbine components, wherein data on the concentricity of the first and second axially-extending spigot contact surfaces of the first rotor is used to establish a primary datum for the stacking of the compressor components, and wherein data on the concentricity of the third and fourth axially-extending spigot contact surfaces of the second rotor is used to establish a primary datum for the stacking of the turbine components.

6. The method defined in claim 1, comprising: using both data on parallelism of axially mating radially-extending faces of the intermediate components and data on the concentricity of a coupling between the first and second rotors in the determination of the stacking angles of the intermediate components.

7. The method defined in claim 1, wherein said first and second rotors have respective stacking surfaces, and wherein the method further comprises measuring parallelism of each of said stacking surfaces to obtain parallelism deviation data, and using said parallelism deviation data in the determination of the stacking angles of the first and second rotors.

8. A method of balancing a rotor assembly of a gas turbine engine, the engine having a first rotor pack comprising a plurality of assembled rotor components and a spigot coupling interface for telescopic connection to a mating spigot of a second rotor pack, the method comprising: measuring a concentricity of said spigot coupling interface of the first rotor pack, establishing a reference axis line based on said concentricity of said spigot coupling interface, measuring the concentricity of at least some of said first rotor components relative to said reference axis line in order to establish individual angular stacking positions of said rotor components, and assembling the first rotor pack using said individual angular stacking positions of said rotor components.

9. The method of claim 8, wherein the reference axis line is obtained by measuring the concentricity of the spigot coupling interface at two axially spaced-apart locations of the spigot coupling interface.

10. The method of claim 9, wherein the spigot coupling interface includes a stepped spigot having first and second axially-extending spigot surfaces having respective first and second diameters, the stepped spigot configured to telescopically engage a mating spigot, and wherein the reference axis line corresponds to an eccentricity between respective centers of said stepped spigot first and second diameters.

11. The method of claim 8, comprising the step of determining the reference axis line based on the concentricity of the spigot coupling interface.

12. The method as defined in claim 11, wherein the reference axis line is determined by defining at least two different axially-extending circumferential surfaces on the spigot coupling interface, measuring the concentricity of each surface of the spigot coupling interface, and determining an off-set between the measured concentricity of the two different axially-extending circumferential surfaces.

13. The method of claim 12, wherein the two different axially-extending circumferential surfaces extend circumferentially about an axis of rotation of a main component of the first rotor pack and wherein measuring the concentricity comprises positioning a probe on each surface, rotating the main component relative to the axis of rotation, maintaining each probe in contact with the respective axially-extending circumferential surfaces during rotation of the main component and recording the distance of each surface from the axis of rotation as a series of points.

14. The method of claim 13, wherein determining an off-set comprises determining a center of rotation for each respective series of points and connecting the respective centers of rotation by a reference line.

15. The method of claim 8, further comprising separately balancing the first and second rotor packs, determining the relative angular positioning of the first and second packs, and assembling the rotor assembly using said relative angular positioning.

16. The method defined in claim 15, wherein said first rotor pack includes a stack of compressor components, said second rotor packs including a stack of turbine components, said spigot coupling interface including first and second telescopic mating faces respectively provided on said first and second rotor packs, and wherein the method comprises obtaining concentricity data on the geometry of the first mating face for use as a primary datum for the stacking of the compressor components, and obtaining concentricity data on the geometry of the second mating face for use as a primary datum for the stacking of the turbine components.

17. The method of claim 16 comprising establishing said coupling interface as a primary datum and referencing said compressor components and said turbine components back to said primary datum.

18. The method of claim 17, comprising individually measuring the concentricity and parallelism of said turbine and compressor components relative to said primary datum.

19. The method of claim 15, wherein a stack of intermediate components are clamped in an axial space defined between axially opposed abutment faces of the first and second rotor packs. and wherein the method comprises measuring parallelism of axially mating faces of said intermediate components, and after having established the relative position of the first and second rotor packs, determining relative angular stacking positions of said intermediate components while considering the axial space defined between said abutment faces and parallelism data obtained on the axially mating faces of the intermediate components.

20. A method of balancing an assembly of rotary components including first and second main components and intermediate components axially positioned in-between, each rotary component having at least one radially-extending mating face, a respective reference and a plurality of stacking positions, the method comprising the steps of:

measuring the concentricity of the first and second main components;

measuring the parallelism of the radially-extending mating faces of the first and second main components relative to the respective references;

generating an assembly unbalance for each combination of first and second main component stacking positions, determining the lowest assembly unbalance and defining the first and second main component stacking positions of the lowest assembly unbalance as optimal first and second main component stacking positions;

measuring the parallelism of the radially-extending mating faces of each intermediate component relative to the respective references;

generating an assembly unbalance for each combination of intermediate component stacking positions relative to the optimal first and second main component stacking positions, determining the lowest assembly unbalance and defining the intermediate component stacking positions of the lowest assembly unbalance as optimal intermediate component stacking positions, wherein both data on parallelism of radially-extending mating faces of the intermediate components and data on the concentricity of a coupling between the first and second main components are used in the determination of the stacking positions of the intermediate components; and assembling the assembly of rotary components.

21. The method as defined in claim 20, wherein the step of measuring the parallelism of the radially-extending mating faces comprises assessing the perpendicularity of the mating faces relative to the reference respective to each component.

22. The method as defined in claim 20, wherein the step of defining the optimal intermediate component stacking positions comprises considering both the first and second main component stacking positions and the parallelism of the radially-extending mating faces of each intermediate component.

* * * * *